United States Patent [19]

Hermes

[11] 4,055,971

[45] Nov. 1, 1977

[54] CLOSED CYCLE APPARATUS FOR THE RAPID, CONTINUOUS AND WATERLESS DYEING OF TEXTILE AND PLASTIC MATERIALS

[75] Inventor: Julius Hermes, Martinsville, Va.

[73] Assignee: Martin Processing, Inc., Martinsville, Va.

[21] Appl. No.: 713,259

[22] Filed: Aug. 10, 1976

[51] Int. Cl.[2] ..... D06B 9/06

[52] U.S. Cl. ..... 68/9; 68/18 R; 68/18 C; 68/18 F; 68/20; 68/205 R; 118/61; 118/67; 118/325; 118/326

[58] Field of Search ..... 68/9, 18 R, 18 C, 18 F, 68/19.1, 20, 205 R; 118/61, 67, 325, 326

[56] References Cited

U.S. PATENT DOCUMENTS

| | | | |
|---|---|---|---|
| 2,532,471 | 12/1950 | Wedler | 68/9 X |
| 3,158,886 | 12/1964 | Grimes | 68/18 C X |
| 3,593,543 | 7/1971 | Bergman | 68/18 C X |
| 3,665,734 | 5/1972 | Hauser et al. | 68/18 C |
| 3,981,162 | 9/1976 | Klier | 68/9 X |

*Primary Examiner*—Philip R. Coe
*Attorney, Agent, or Firm*—Stevens, Davis, Miller & Mosher

[57] ABSTRACT

The present invention relates to a closed cycle apparatus for the rapid, continuous and waterless dyeing of a textile or plastic material with a dyestuff dissolved or suspended or dispersed in a high boiling solvent (such as glycol or glycol ether or other members of the alcohol family) for carrying out the dyeing step, after which the dyed textile or plastic material subsequent to cooling is washed with a low boiling liquid (such as methanol or ethanol) and then dried. The apparatus is constructed so as to operate under non-aqueous or substantially non-aqueous conditions with the complete or substantially complete recovery and recycling of the used dyestuff, the used high boiling solvent and the used low boiling wash liquid. In this way, the apparatus can be operated at a relatively low cost and in a completely or substantially completely closed cyclic system with essentially complete recovery and reuse of the treating fluids so as to greatly minimize the cost of operating the dyeing apparatus and also without any pollution of our natural water resources. Pollution of many of our rivers and wells has taken place in the past where effluents of a substantially aqueous nature containing serious amounts of polluting substances were discharged into rivers and the like thereby creating environmental problems.

38 Claims, 5 Drawing Figures

CLOSED CYCLE APPARATUS FOR THE RAPID, CONTINUOUS AND WATERLESS DYEING OF TEXTILE AND PLASTIC MATERIALS

BACKGROUND OF THE INVENTION

This invention is directed to an apparatus for the rapid, continuous and waterless or essentially waterless dyeing of textile and plastic materials. Due to the current emphasis upon pollution control and interest in protecting the environment, it is evident that more effective measures for pollution control of industrial machinery are becoming increasingly necessary in view of the stringency of the controls and the high cost of implementing them which, in many cases, must be passed on to the consumer in the form of higher prices. In the case of dye plants, it is extremely expensive to treat the effluents therefrom, and in some cases an effluent treatment sufficient to bring about approval by environmental protection authorities is nowadays prohibitively expensive. There are communities, in fact, throughout various parts of the world that do not even allow dyeing and finishing plants to be located within their borders due to their attendant pollution problems.

The present invention relates to a dyeing apparatus for dyeing textiles and plastic materials that will eliminate or substantially eliminate all polluting effluents as well as the air pollution that might otherwise result from the dyeing operation. After the initial capital expenditure for the necessary machinery, the apparatus described hereinafter is relatively inexpensive to operate and, in an energy-conscious world, requires considerably less energy to keep in operation. This latter is in and of itself a most attractive feature of the apparatus in these days of expensive energy and anticipated energy shortages in the very near future.

SUMMARY OF THE INVENTION

It is therefore a principal object of this invention to avoid the prior art disadvantages in the dyeing of textile and plastic materials. More specifically, it is an object of this invention to provide an apparatus for the rapid, continuous and waterless dyeing of textile and plastic materials.

Another object of the invention is to provide an improved apparatus for dyeing textile and plastic materials wherein the apparatus will not require any significant water input or produce any polluting effluents therefrom.

A futher object of the invention is to provide a dyeing apparatus for textile and plastic materials which minimizes energy requirements for the operation thereof.

A further object of the invention is to provide an apparatus for dyeing of textile and plastic materials which will allow a dyeing plant to conform with stringent federal and local pollution standards and have relatively low operating costs.

A futher object of the invention is to provide an apparatus for dyeing textile and plastic materials which does not require any significant input of water and, therefore, does not necessitate a location proximate to a water source such as a river or a well.

A still further object of the invention is to provide an apparatus for dyeing textile and plastic materials which will eliminate all polluting effluents as well as air pollution that might otherwise result from a dyeing operation.

These and still further objects which will be more evident hereinafter are obtained by the closed cycle apparatus disclosed herein for the rapid, continuous and waterless dyeing of a textile or plastic material with a dyestuff dissolved, suspended or dispersed in a high boiling organic liquid which is free or substantially free of water and at a relatively high temperature.

The closed cycle dyeing apparatus for the rapid, continuous and waterless dyeing of a textile or plastic material comprises a dyeing apparatus for dyeing the textile or plastic material and recycling the used dye (comprised of a dyestuff dissolved or suspended or dispersed in a high boiling organic liquid) to the dyeing apparatus, means for cooling and padding the dyed textile or plastic material (where its temperature may be reduced from about 400° to about 100° F.) and condensing vapors from the residual high boiling organic liquid and returning them to the dyeing apparatus and also returning the residual dye to the dye apparatus, means for washing the dyed and cooled textile or plastic material with a low boiling organic liquid (such as methanol or ethanol) which is free or substantially free of water and separating the wash liquor from the residual high boiling organic liquid and residual dyestuff and returning them to the washing means and the dyeing apparatus, respectively, means for drying the dyed and washed textile or plastic material and for condensing the vapors from the residual low boiling organic wash liquid and returning them to the washing means and means for taking-up or packaging the dyed textile or plastic material.

The closed cycle dyeing apparatus of the present invention can be utilized in the dyeing of polyester textile materials, nylons, orlon or other well known commercial textile materials, both synthetic and natural, and other similar articles. Textile material being dyed by the apparatus of the present invention may be any of the conventional forms well known in the art, such as continuous filament yarn, staple yarn, tow, fabric or the like. This material, if in yarn form, may be a warp of yarn comprised of a large number of individual yarn ends.

BRIEF DESCRIPTION OF THE DRAWINGS

Some of the objects of the invention having been stated, other objects will become evident as the description proceeds, when taken in conjunction with the accompanying drawings, in which.

DETAILED DESCRIPTION OF THE PREFERRED EMBODIMENT

Figure 1A:
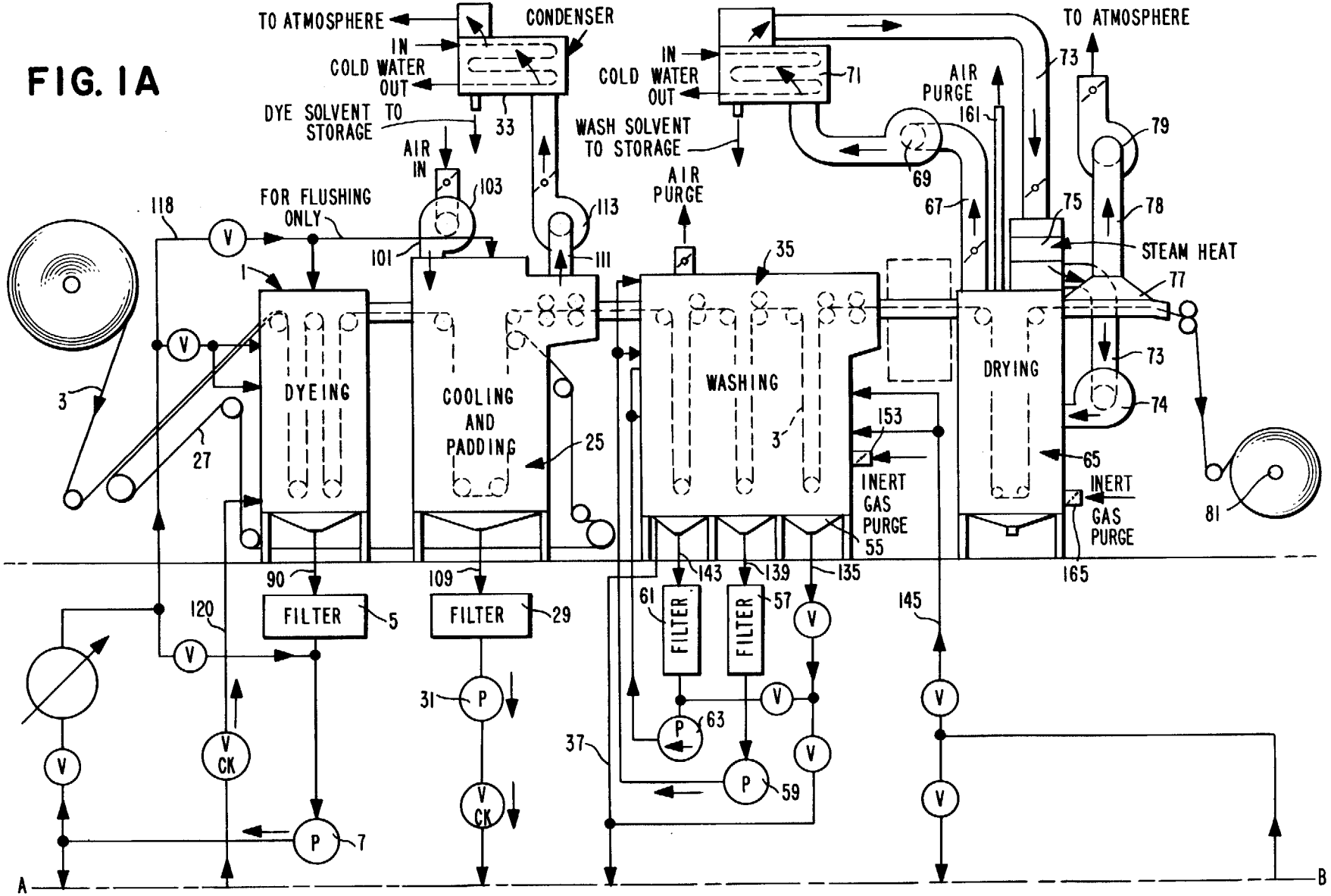
FIG. 1 (A and B) is a schematic diagram of the apparatus according to the present invention.
Figure 1B:
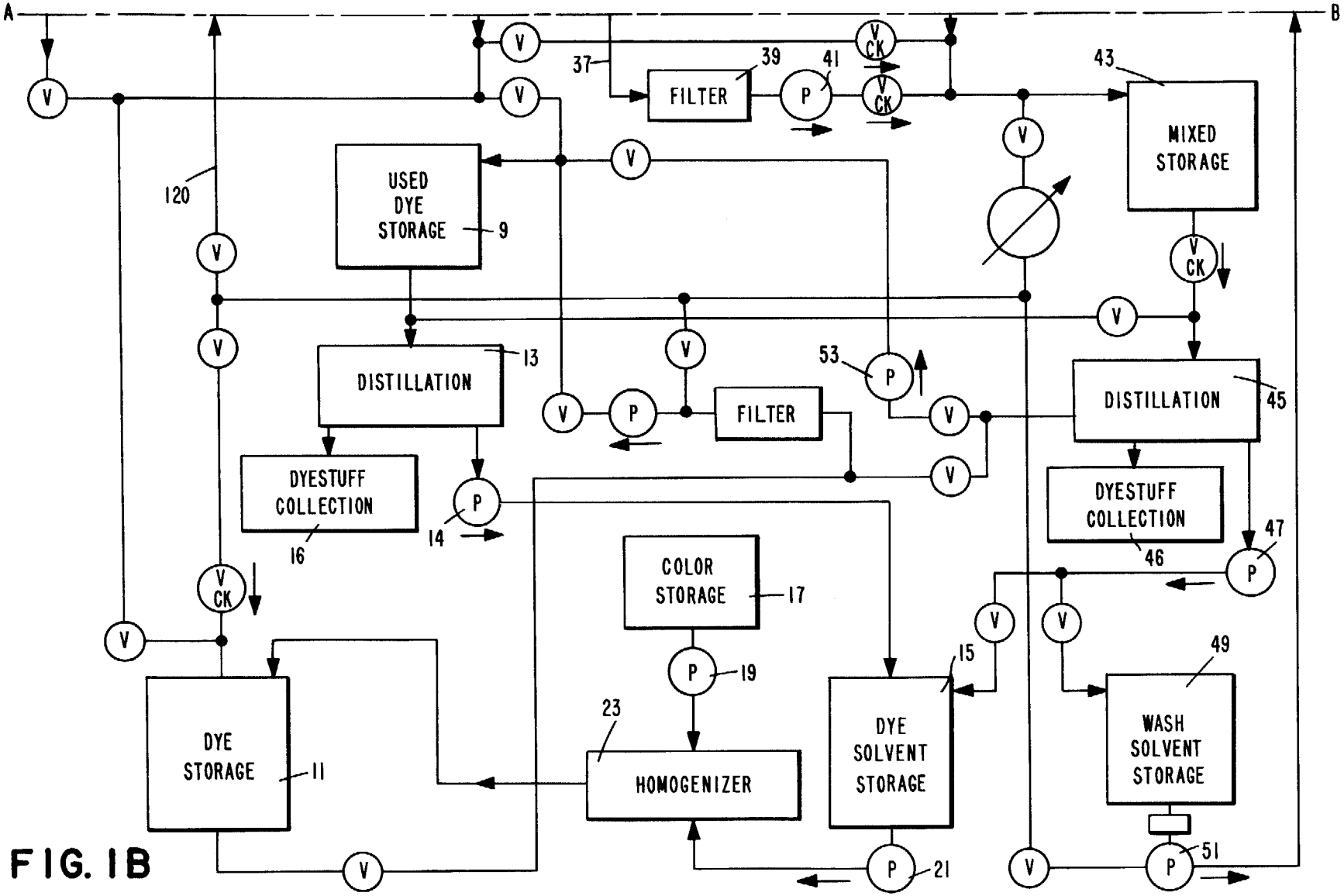

Referring now more specifically to the drawings, a closed cycle apparatus for the rapid, continuous and waterless dyeing of a textile or plastic material with a dyestuff dissolved, suspended or dispersed in a high boiling organic liquid which is free or substantially free of water and at a relatively high temperature according to the present invention is shown in FIG. 1. This apparatus comprises a dyeing apparatus 1 for dyeing the textile or plastic material 3. A filter 5, a fluid pump 7, a used dye storage reservoir 9, a dye storage reservoir 11, a distillation apparatus 13, a dyestuff collection reservoir 16, a fluid pump 14, a dye solvent storage reservoir 15, a color (dyestuff) storage reservoir 17, a fluid pump 19, a fluid pump 21 and a homogenizer 23 are utilized for recycling of the used dye from the dyeing apparatus 1 back to the same apparatus.

The textile or plastic material 3 is next transported to the means for cooling and padding 25 by the tenter conveyor 27 (which is arranged so as to continuously convey the textile or plastic material 3 through the dyeing apparatus 1 and the means for cooling and padding 25). The tenter conveyor 27 allows for both longitudinal and transverse shrinkage of the material 3 on the conveyor. A filter 29, a fluid pump 31, a used dye storage reservoir 9, a dye storage reservoir 11, a distillation apparatus 13, a dyestuff collection reservoir 16, a pump 14, a dye solvent storage reservoir 15, a dyestuff storage reservoir 17, two fluid pumps 19 and 21 and a homogenizer 23 comprise the apparatus for recycling of the residual dye from the means for cooling and padding 25 back to the dyeing apparatus. Also, the vapors from the residual high boiling organic liquid are recycled by condensing the same in condenser 33 and transporting the condensed dye solvent to the dye solvent storage reservoir 15.

The dyed and cooled textile plastic material 3 is next conveyed to the means for washing 35 where it is washed with a low boiling organic wash liquor (such as methanol). The means for washing 35 is comprised of a plurality of tanks 55, a filter 57, a fluid pump 59, a filter 61, a fluid pump 63. Apparatus associated with the means for washing 35 for separating the wash liquor from the residual high boiling organic liquid and residual dyestuff contained therein and recycling of same to the means for washing 35 and the dyeing apparatus 1 comprise a conduit 37 for transporting the run-off wash liquor (containing the high boiling organic liquid and residual dyestuff), a filter 39, a fluid pump 41, a mixed storage reservoir 43, a distillation apparatus 45, a dyestuff collection reservoir 46, a fluid pump 47, a wash solvent storage reservoir 49, a fluid pump 51 for pumping the distilled wash liquor back to the means for washing 35, a fluid pump 53, a used dye storage reservoir 9, a distillation apparatus 13, a dyestuff collection reservoir 16, a fluid pump 14, a dye solvent storage reservoir 15, a dyestuff storage reservoir 17, fluid pumps 19 and 21, a homogenizer 23 and a dye storage reservoir 11.

The means for drying 65 the dyed and washed textile or plastic material 3 comprises exhaust conduit 67, an air blower 69, a condenser 71, an air inlet conduit 73, a heating means 75, an air blower 74, a wash solvent storage reservoir 49 and a fluid pump 51 for condensing vapors from the residual low boiling organic liquid and returning them to the means for washing 35. Adjacent the means for drying 65 is a terminal air lock 77 comprising an air blower 79 and a conduit 78. A means for taking-up 81 packages the finished material 3.

If the material 3 is not dry upon exiting the means for drying 65, a condenser can be connected to the air blower 79 for collecting any residual wash liquor vapors in the exhausted air from the terminal air lock 77. The condenser would be fluidly connected to the wash solvent reservoir 49 so as to transport the condensed wash liquor vapors thereto.

Figure 2:
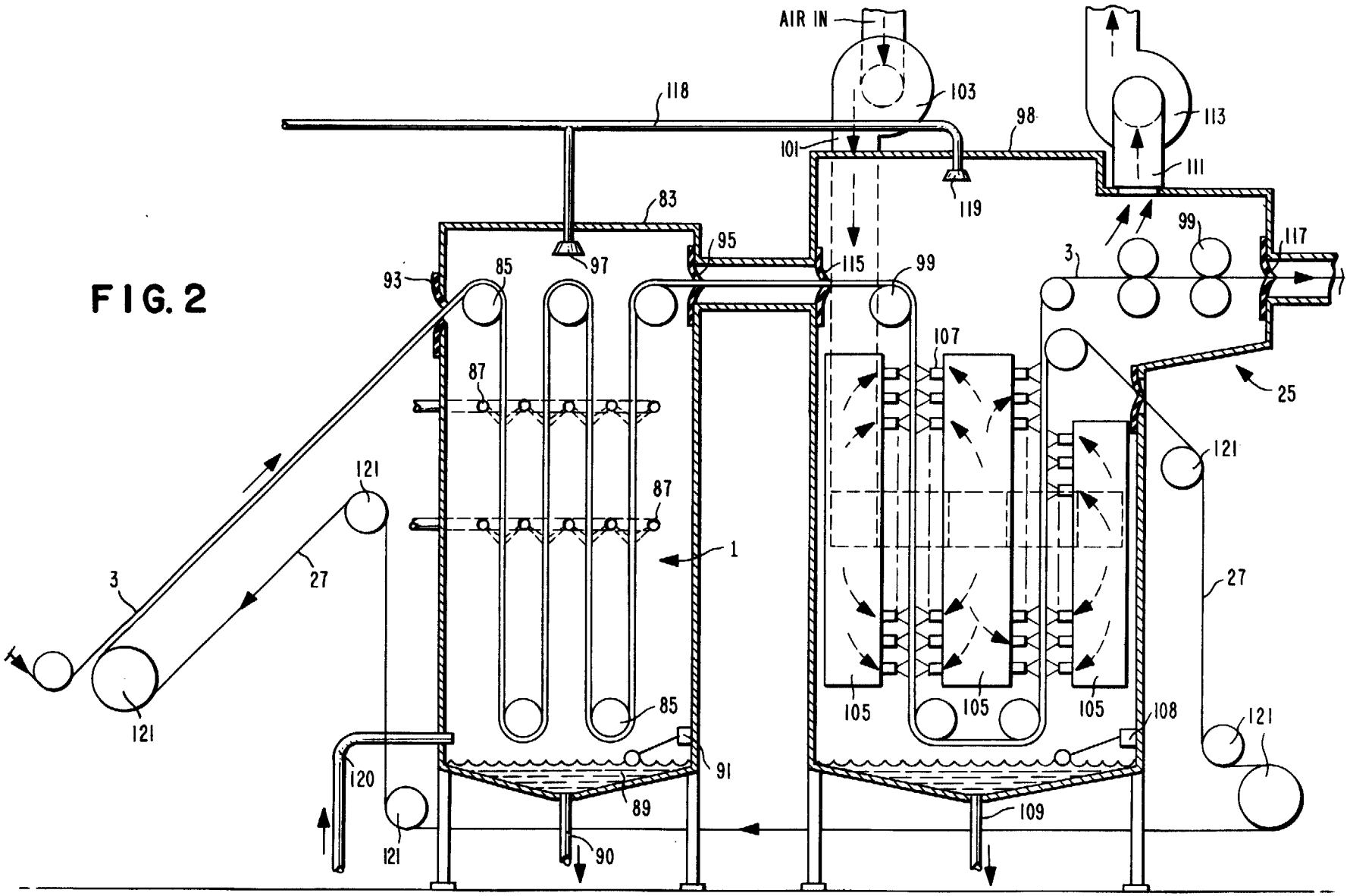
FIG. 2 is a cross-sectional side view of the dyeing apparatus and the means for cooling and padding the textile or plastic material according to the present invention.

With reference to FIG. 2, the dyeing apparatus 1 comprises an exterior housing 83, input conduit 120 and drain conduit 90, a plurality of rollers 85 disposed within the housing 83 for conveying the material 3 therethrough, a plurality of spray means 87 disposed so as to spray dye on the material 3 as it passes thereadjacently, a receptacle means 89 at the bottom of the housing 83 for receiving the excess dye which is not absorbed by the material 3 while passing through the dyeing apparatus 1, a switch means 91 disposed within the housing 83 for actuating associated apparatus for recycling the dye when the level thereof within the receptacle means 89 reaches a predetermined depth, a first air lock 93 and a second air lock 95 for minimizing the amount of oxygen allowed within the housing 83 and a flushing spray means 97 for cleansing the dyeing apparatus with a low boiling organic liquid such as methanol.

The means for cooling and padding 25 comprises an exterior housing 98, a plurality of rollers 99 for conveying the material 3 therethrough, an air inlet conduit 101 with a fluidly connected air blower 103, a plurality of air plenums 105 fluidly engaging the air inlet conduit 101, a plurality of air jets 107 fluidly engaging the air plenums 105, a conduit 109 fluidly connected to the apparatus for withdrawing residual dye collected in the housing 98 and recirculating the dye to the dyeing apparatus 1, an air exhaust conduit 11 fluidly connected to an air blower 113 for withdrawing residual high boiling organic liquid vapors from the housing 98 and transporting them to the condenser 33 (FIG. 1) and recycling of the dye solvent ultimately back to the dyeing apparatus 1, an air lock 115 and an air lock 117 for minimizing the oxygen allowed within the housing 98, a flushing spray means 119, a conduit 118 fluidly connected thereto, a tenter conveyor 27 for transporting the material 3 through both the dyeing apparatus 1 and the means for cooling and padding 25 in a continuous fashion over the internal rollers 85 and 99, respectively, and external rollers 121 so as to allow the material 3 to shrink in a longitudinal and transverse direction thereon.

Figure 3:
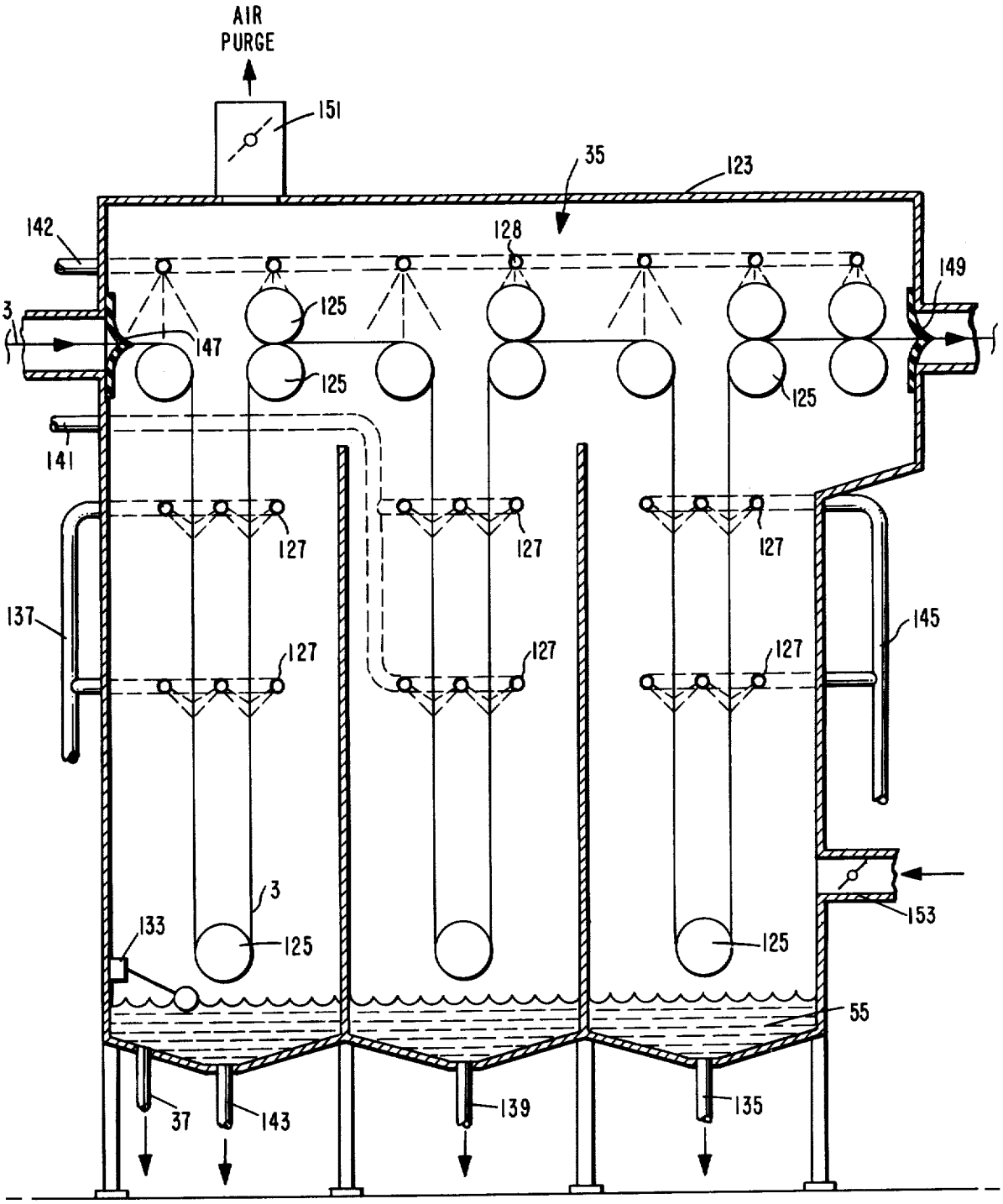
FIG. 3 is a cross-sectional side view of the means for washing the dyed textile or plastic material according to the present invention.

With reference to FIG. 3, the means for washing 35 the dyed textile or plastic material comprises a housing 123, a plurality of rollers 125 within the housing 123 for conveying the material 3 therethrough, a plurality of spray means 127 positioned substantially adjacent the material 3 for spraying wash liquor thereon, a plurality of flushing spray means 128, a conduit 142 fluidly engaging said flushing spray means 128, a conduit 141 fludily engaging a portion of spray means 127, a conduit 137 fluidly engaging a portion of spray means 127, a plurality of wash tanks 55 positioned at the bottom of the housing 123 for collecting residual wash liquor not absorbed by the material 3, a conduit 37 for recycling of the wash liquor and dye contained therein back to the means for washing 35 and the dyeing apparatus 1 (FIG. 1), respectively, a switch means 133 for actuating the pump 41 (FIG. 1) for recycling of the wash liquor containing dye therein, a conduit 135 for recycling of the wash liquor through fluid pump 59 (FIG. 1) to conduit 141 and the associated spray 127, a conduit 139 for recycling of the wash liquor through filter 57 (FIG. 1) and fluid pumps 59 and 63 (FIG. 1) to conduits 141 and 137 and the associated spray means 127, a conduit 143 for recycling of the wash liquor through filter 61 (FIG.

1) and fluid pump 63 (FIG. 1) to conduit 137 and the associated spray means 127, a conduit 145 fluidly connecting the wash solvent storage reservoir 49 (FIG. 1) and fluid pump 51 (FIG. 1) to the spray means 127 associated with the first of the plurality of wash tanks 55, a first air lock 147 at the entrance of the housing 123 and a second air lock 149 at the exit of the material 3 from the housing 123 for creating a substantially vapor-tight and oxygen-free environment within the housing, an air purge vent 151 to the atmosphere, and an inert gas purge 153 to the atmosphere.

Figure 4:
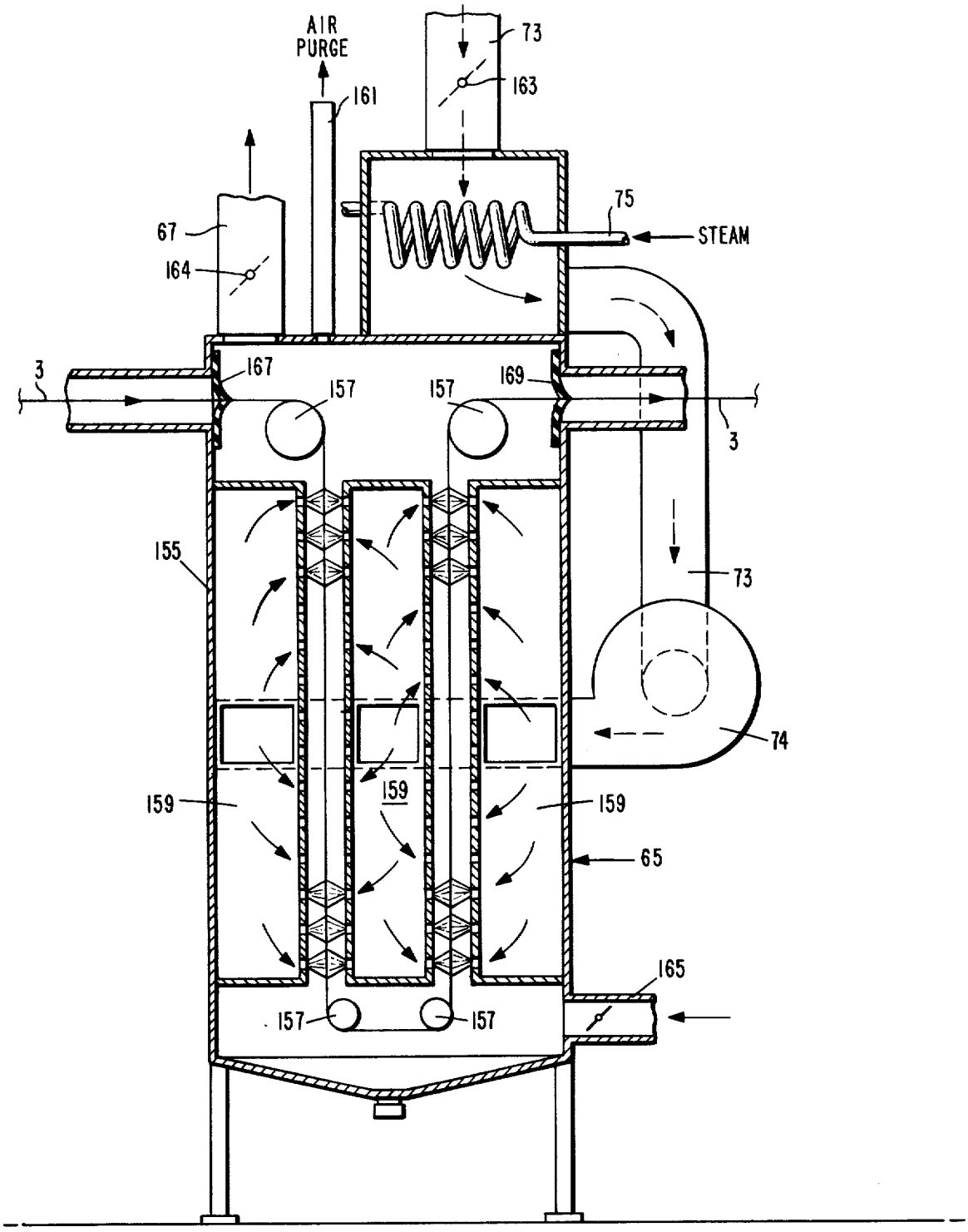
FIG. 4 is a cross-sectional side view of the means for drying the dyed and washed textile or plastic material according to the present invention.

With reference to FIG. 4, the means for drying 65 the dyed and washed textile or plastic material 3 comprises an exterior housing 155, a plurality of rollers 157 to convey the material 3 therethrough said housing 155, an air inlet conduit 73 with a fluidly connected air blower 74, a plurality of air plenums 159 with holes in the surface thereof and positioned within the housing 155 so as to be substantially adjacent the material 3 traversing therethrough, an exhaust conduit 67, an air purge vent 161, a heating means 75 disposed within the air inlet conduit 73 so as to allow entering air to pass substantially thereby, a vent means 163 rotatably disposed within the air inlet conduit 73 for controlling the flow of air into the housing 155, a vent means 164 for controlling the flow of air from the housing 155, an inert gas purge vent 165 to the atmosphere, a first air lock 167 positioned at the entrance of the material 3 to the housing 155 and a second air lock 169 positioned at the exit of the material 3 from housing 155.

The manner of operations of the closed cycle apparatus for the rapid, continuous and waterless dyeing of a textile or plastic material will be readily apparent from the foregoing description. The textile or plastic material 3 is dyed in a dyeing apparatus 1 by means of a dyestuff dissolved or dispersed or suspended in a high boiling solvent (such as glycol or glycol ether). The material 3 can ideally be a polyester textile material from which the apparatus of the present invention is particularly desirable, but it may also be such materials as nylon, orlon or other well known textile or plastic materials in such conventional forms well known to the art as a continuous filament yarn, staple yarn, tow, fabric or the like. The material, if in yarn form, may be a warp comprising hundreds of individual yarn ends in a sheet of material.

The residual dye collects in receptacle 89 and when the switch means 91 senses that a predetermined level of the dye has collected it actuates the fluid pump 7 which pulls the dye through the filter 5 and may either pump it back to the spray means 87 or at the end of a dyeing run pump it to the dye storage reservoir 11 or the used dye storage reservoir 9 depending upon which valves along the conduits thereto are open. If the dye was pumped by the fluid pump 7 through the used dye storage reservoir 9 it is then transported to the distillation apparatus 13 where the high boiling organic liquid is distilled off and pumped by the fluid pump 14 to the dye solvent storage reservoir 15. The remaining dyestuff is collected in the dyestuff collection reservoir 16. From the dye solvent storage reservoir 15 the high boiling point liquid is pumped via fluid pump 21 into a homogenizer and mixed with a dyestuff from color storage reservoir 17 which is pumped thereto by fluid pump 19. The dyestuff and high boiling organic liquid subsequent to being mixed by the homogenizer 23 are transported to the dye storage reservoir 11. From the dye storage reservoir 11 the dye can be transported or recycled back to the dye apparatus 1.

If the residual dye from the dyeing apparatus was initially pumped via fluid pump 7 to the dye storage reservoir 11, makeup dye can be added via input from the dye solvent storage reservoir 15 and the color storage reservoir 17 into the homogenizer 23 from which it is transported to dye storage reservoir 11 and mixed with the existing residual dye. The dye can then be recycled back to the dyeing apparatus 1. In this manner, the dye being transported from the dye storage reservoir 11 to the dyeing apparatus 1 for the dyeing of the material 3 being conveyed therethrough can be continuously recycled with the addition of any necessary dyestuff or high boiling organic liquid. Furthermore, if the residual dye is processed through the distillation apparatus 13 so as to distill off the high boiling point liquid and transport same to the dye solvent storage reservoir 15, a concentrated dyestuff is collected in the dyestuff collection reservoir 16 to be reused at a later date.

It should be emphasized that as a general matter the residual dye in the dyeing apparatus 1 is recycled through filter 5 and via fluid pump 7 directly back to the plurality of spray means 87 within the housing 83. Conduit 120 allows for an input of dye from the dye storage reservoir 11 when make-up dye is needed.

The material 3 is transported through the dyeing apparatus 2 and through the next adjacent means for cooling and padding 25 by tenter conveyor 27 which continuously travels about the rollers 85 within the dyeing apparatus 1, the rollers 99 within the means for cooling and padding and the external rollers 121 disposed thereadjacent to the above-noted apparatus. The tenter conveyor 27 allows the material 3 to shrink in both a longitudinal and transverse direction.

The dyed material 3 subsequently passes to the means for cooling and padding 25 where it is conveyed by the tenter conveyor 27 about rollers 99 and thereadjacent air plenums 105 and associated air jets 107 to reduce its temperature from about 400° F. to about 100° F. The means for cooling and padding 25 admits air into the housing 98 via an air inlet conduit 101 which fluidly engages the air plenums 105 at one end and at the other an air blower 103 which forces air through the conduit and into the air plenums 105. Residual high boiling organic liquid and dyestuff contained therein collects at the bottom of the housing 98 and when the level thereof reaches a predetermined depth a switch means 108 actuates fluid pump 31 which pulls the residual dye through conduit 109, filter 29 and pumps it to either the used dye storage reservoir 9 or the dye storage reservoir 11 depending upon the valve settings of the conduits therebetween. As noted hereinbefore, if the residual dye has been collected in the used dye storage reservoir 9 it can be subsequently distilled in the distillation apparatus 13 at the end of a dyeing run and pumped via fluid pump 14 to the dye solvent storage reservoir 15. The remaining dyestuff can be collected in the dyestuff collection reservoir 16. The high boiling organic liquid is pumped via fluid pump 21 to the homogenizer 23 and concurrently dyestuff is also pumped thereto from the color storage reservoir 17 by fluid pump 19. The homogenizer 23 mixes the high boiling organic liquid and the dyestuff to create a dye which is collected in the dye storge reservoir 11. From the dye storage reservoir 11 the dye is then transported to the dye apparatus 1. If the dye collected in the bottom of the means for cooling and padding 25 was originally pumped by fluid pump 31 to the dye storage reservoir 11 it can, of course, be then recycled directly back to the dyeing apparatus 1 after make-up dye is added from homogenizer 23.

The means for cooling and padding 25 also possesses an air exhaust conduit 111 with a fluidly connected air blower 113 for drawing off vapors of the high boiling organic liquid. The air blower 113 forces these vapors through the condenser 33 whereby they are condensed to liquid from and recycled back to the dye solvent storage reservoir 15 to be subsequently mixed in the homogenizer 23 with a new input of dyestuff from the color storage reservoir 17.

Both the dyeing apparatus 1 and the means for cooling and padding 25 possess a flushing spray means 97 and 119, respectively which are fluidly connected via conduit 118 to the wash solvent storage reservoir 49. When it is desired to clean the interior of the housings 83 and 98 the low boiling organic solvent is pumped via fluid pump 51 from the wash solvent storage reservoir 49 to conduit 118 and through the flushing spray means 97 and 119 so as to clean the dyeing apparatus 1 and the means for cooling and padding 25 in a simultaneous fashion in as little time as 5 minutes. The material 3 possesses an approximately 40% solvent content when it is conveyed from the means for cooling and padding 25 to the means for washing 35.

The dyed and cooled material 3 next passes to the means for washing 35. The material 3 first passes through the air lock 147 at the entrance thereof to the housing 123. The entrance air lock 147 and the exit air lock 149 both provide a low oxygen environment within the housing 123. It is most important to provide the low oxygen atmosphere within the housing 123 since the wash liquor utilized can be methanol which is explosive when combined with approximately 20 - 36% oxygen atmosphere. In other words, the air locks assist in providing a low oxygen atmosphere below the explosive range noted hereinbefore. The material 3 passes about rollers 125 and passes thereadjacent to a plurality of spray means 127 which spray the dyed and cooled material 3 with a low boiling organic solvent (e.g. methanol). The run-off wash liquor containing residual high boiling organic solvent and dyestuff collects at the bottom of the housing 123 in a series of wash tanks 55 with the cleanest tank being the one most remote from the dyeing apparatus and the most contaminated tank being that tank nearest the dyeing apparatus 1. Clean wash liquor is pumped from the wash solvent storage reservoir 49 via fluid pump 51 to conduit 145 and through the plurality of spray means 127 associated therewith.

Run-off wash liquor and dye contained therein collects in the first wash tank therebeneath the hereinbefore noted plurality of spray means 127 and passes through conduit 135 to fluid pump 59, and is pumped through conduit 141 to the plurality of spray means 127 disposed above the middle tank of said wash tanks 55. The plurality of spray means 127 disposed above the middle wash tank spray the material 3 and the wash liquor and dye contained therein collect in the middle tank of the wash tanks 55. The fluid is pulled through conduit 139, filter 57 and fluid pumps 59 and 63 pump it to conduits 141 and 137 which convey the wash liquor back to the plurality of spray means 127 disposed above the second and third wash tanks. The wash liquor and dye contained in the third of the wash tanks 55 flows through conduit 143, filter 61 and is pumped by fluid pump 63 back to conduit 137 and the associated plurality of spray means 127 disposed above the third wash tank. It should be noted that fluid pump 59 is also fluidly connected to conduit 142 and if a valve therebetween is open wash liquor can be pumped through the plurality of flushing spray means 128 disposed above the rollers 125 so as to clean the rollers 125 and interior of the means for washing 35 at the end of a dyeing run.

When the level of wash liquor within the third of the series of wash tanks 55 reaches a predetermined depth a switch 133 actuates fluid pump 41 which pulls the contaminated wash liquor from this third tank through conduit 37 and filter 39 and pumps the contaminated wash liquor to the mixed storage reservoir 43. The contaminated wash liquor passes from the mixed storage reservoir 43 to the distillation apparatus 45 which distills off the low boiling organic wash liquid (e.g. methanol) first, and fluid pump 47 pumps this wash liquor to the wash solvent storage reservoir 49. From the wash solvent storage reservoir 49 the wash liquor is pumped via fluid pump 51 back to conduit 145 and the associated plurality of spray means 127 disposed above the first of said wash tanks 55. Once the wash liquor is distilled the distillation apparatus 45 contains the high boiling organic liquid and the dyestuff contained therein, and the high boiling organic liquid can be distilled off and pumped via fluid pump 47 to the dye solvent storage reservoir 15. If this is done, the remaining dyestuff can be collected in the dyestuff collection reservoir 46. Alternatively, the remaining high boiling organic liquid and dyestuff therein can be pumped via fluid pump 53 to the used dye storage reservoir 9. From there the dye can be further processed and transported as has been indicated hereinbefore.

It should be noted that ideally the distillation apparatus 45 and 13 can be of the semi-batch type so as not to require a significant cleaning time. It can be expected that the semi-batch distillation apparatus could be cleaned in a five minute cycle.

The textile or plastic material 3 next passes to the means for drying 65 where the material will be reduced from an approximately 40 - 60% solvent content to about 20 - 0%. The material is conveyed through the housing 155 by a plurality of rollers 157. Air is pulled through the air inlet conduit 73 and over a heated steam pipe 75 by air blower 74, and the blower forces the heated air into the fluidly connected plurality of air plenums 159 disposed in a manner substantially adjacent the path of travel of the material 3 through the means for drying 65. The plurality of air plenums 159 possess a plurality of holes therein through which the heated air passes thereagainst the material 3 conveyed thereby. An air exhaust conduit 67 is fluidly connected to an air blower 69 which pulls exhaust air from within the housing 155, and forces the air containing wash liquor vapors through condenser 71. The condensed wash liquor (low boiling organic liquid) is then transported to the wash solvent storage reservoir 49 for recycling via fluid pump 51 to the means for washing 35. The condenser 71 is fluidly connected to the air inlet conduit 73 so that the air passing therethrough condenser 71 is then recycled back to the air inlet conduit 73, the steam pipe 75 and air blower 74. The material 3 then exits the housing 155 via air lock 169 and passes through the terminal air lock 77. The terminal air lock comprises a fluidly engaged conduit 78 and air blower 79 so as to pull atmospheric or room air into the terminal air lock 77 and deodorize the material 3 passing therethrough to the take-up apparatus 81. The only input of water required for the entire closed cycle apparatus is the quite nominal requirements of cold water for the condensers 33 and 71.

If the material 3 leaving the means for drying 65 is not entirely dry, a final drying stage can be effected by connecting a condenser to air blower 79 for collecting residual wash liquor vapors in the exhaust air from terminal air lock 77. The wash liquor would be transported to the wash solvent storage reservoir 49.

By way of still further illustration of the inventive apparatus, the following examples of dyeing are set forth:

EXAMPLE 1

A polyester fabric was dyed in diethylene glycol containing 1% of Disperse Blue 60. The sample was dyed and heat set at 380° for 15 seconds, cooled for 10 seconds, washed with methanol for 15 seconds and hot air dried for 15 seconds.

EXAMPLE 2

A nylon carpet was dyed in ethylene glycol containing 2% of Acid Red 151. The sample was dyed at 340° F. for 30 seconds, cooled for 20 seconds, washed with methanol for 30 seconds and hot air dried for 30 seconds.

EXAMPLE 3

A wool felt was dyed in ethylene glycol containing 1% Acid Blue 25. The sample was dyed at 310° F. for 20 seconds, cooled for 15 seconds, washed with methanol for 25 seconds and hot air dried for 25 seconds.

All of the above examples gave excellent dyeing results with good color and fastness properties.

It should be noted in passing that others have suggested dyeing a textile material in a nonaqueous dye bath such as a glycol or a glycol ether. Societa Rhodiaceta's French Pat. No. 955,260 (and the generally corresponding Swiss Pat. No. 230,891) suggested such a step for the dyeing of nylon many years ago. Moreover, more recently Laucius et al, in U.S. Pat. No. 2,882,119, suggested the dyeing of polyester in a nonaqueous dyebath comprising various glycols. See also Olpin et al U.S. Pat. No. 2,461,612. Moreover, others have suggested the step per se of washing dyed textile products with a low boiling liquid, such as an alcohol, as in the Rhodiaceta patents mentioned above, although there it is a matter of indifference whether water or a low boiling alcohol is employed as the washing liquid. See the French patent at page 2, lines 58 et seq. However, neither the prior art just cited nor any other prior art, so far as I am aware, has suggested, much less recognized, an inventive dyeing apparatus as disclosed and claimed herein having a capacity to recycle the various materials involved and requiring substantially no water for the operation thereof, with the attendant advantage of lesser costs, and more importantly, with a view to present-day environmental and energy-conservation considerations.

It will thus be seen that there has been described above a closed cycle apparatus for the rapid, continuous and waterless dyeing of textile and plastic materials. The apparatus enables the dyeing of textile or plastic material under non-aqueous or substantially non-aqueous conditions with a complete or substantially complete recovery and recycling of used dyestuff, used high boiling solvent and used low boiling wash liquor. The apparatus is capable of operation in a relatively inexpensive fashion and in a completely or substantially completely closed cycle system so as to minimize the cost of the operation and so as not to pollute natural water resources such as rivers and wells as do prior art apparatus.

While the invention has been described with particular reference to the preferred embodiments shown in the drawings, this not to be considered as limiting its natural scope.

What is claimed is:

1. A closed cycle apparatus for the rapid, continuous and waterless dyeing of a generally continuous textile or plastic material with a dye comprising dyestuff dissolved or suspended or dispersed in a high boiling organic liquid which is free or substantially free of water and at a relatively high temperature comprising:

a dyeing apparatus for dyeing the textile or plastic material and recycling the used dye to the dyeing apparatus;

means for cooling and padding the dyed textile or plastic material and condensing vapors from the hot residual high boiling organic liquid and returning the vapors to said dyeing apparatus and returning the residual used dye to said dyeing apparatus;

means for washing the dyed textile or plastic material with a low boiling organic liquid which is free or substantially free of water and separating the used wash liquor from the residual high boiling organic liquid and residual dyestuff and returning said used wash liquor to the washing means and residual high boiling liquid and residual dyestuff to said dyeing apparatus, respectively;

means for drying the dyed and washed textile or plastic material and condensing vapors from the used residual low boiling organic liquid and returning said vapors to said washing means;

said dyeing apparatus, said means for cooling and padding, said means for washing, and said means for drying being arranged in series;

means for conveying the textile or plastic material successively through said dyeing apparatus, said means for cooling and padding, said means for washing, and said means for drying; and means for taking-up the dyed, washed and dried textile or plastic material.

2. A closed cycle apparatus as claimed in claim 1, including a tenter conveyor for conveying the textile or plastic material through both said dyeing apparatus and said means for cooling and padding, said tenter conveyor permitting longitudinal and transverse shrinkage of the textile or plastic material thereon.

3. A closed cycle apparatus as claimed in claim 1, wherein the dyeing apparatus comprises:

an exterior housing constructed so that the textile or plastic material traverses therethrough;

a plurality of rollers disposed within said housing for conveying the textile or plastic material therethrough;

a plurality of spray means disposed within said housing and substantially adjacent the path of travel of said textile or plastic material for spraying dye thereon;

a receptacle means for receiving the excess high boiling organic liquid and residual dyestuff which is not absorbed by the textile or plastic material being processed through said dyeing apparatus; and means for recycling the high boiling organic liquid and residual dyestuff from said receptacle means to said plurality of spray means.

4. A closed cycle apparatus as claimed in claim 3, wherein said plurality of spray means comprises a plurality of spray heads positioned transversely across said housing with each of the heads comprising a plurality of spray jets directed towards the textile or plastic material passing adjacent thereto.

5. A closed cycle apparatus as claimed in claim 4, including a switch means for actuating said means for recycling the high boiling organic liquid and residual dyestuff when the level thereof within said receptacle means reaches a predetermined depth.

6. A closed cycle apparatus as claimed in claim 5, wherein the means for recycling the high boiling organic liquid and residual dyestuff comprises:

a filter means fluidly engaging said receptacle means;
a first pump fluidly engaging said filter means;
a used dye storage means;
a make-up dye storage means;
a first conduit means fluidly connected at a first point to said first fluid pump, at a second point to said used dye storage means, and at a third point to said make-up dye storage means;
a control means fluidly connected to said first conduit for controlling whether the used dye is pumped to said used dye storage means or said make-up dye storage means;
a distillation apparatus with associated pump means for separating high boiling organic liquid from dyestuff contained therein;
a second conduit means fluidly connected at one end to said dye storage means and at the other end to said distillation apparatus for transporting the used dye to said distillation apparatus;
a high boiling organic liquid storage means;
a fresh dyestuff storage means;
a third conduit means fluidly connected at one end to said distillation apparatus and at the other end to said high boiling organic liquid storage means for transporting the distilled high boiling organic liquid to said high boiling organic liquid storage means thereby leaving only concentrated dyestuff in said distillation apparatus;
a second fluid pump and third fluid pump fluidly connected to said dyestuff storage means and said high boiling organic liquid storage means, respectively;
a homogenizer fluidly connected to said second and third fluid pumps for blending the high boiling organic liquid and the fresh dyestuff into a dye;
a fourth conduit means fluidly connected at one end to said homogenizer and at the other end to said dye storage means for transporting the dye to said dye storage means prior to its use in said dye apparatus;
means for transporting dye from said dye storage means to said dyeing apparatus; and
a fifth conduit means fluidly connected at one end to said first fluid pump and at the other end to said plurality of spray heads for directly recycling the residual dye.

7. A closed cycle apparatus as claimed in claim 6, including a first air lock positioned at the entrance of the textile or plastic material into said exterior housing and a second air lock positioned at the exit of the dyed textile or plastic material from said exterior housing and located substantially between said dye apparatus and said means for cooling and padding so as to minimize the amount of oxygen allowed into said dyeing apparatus.

8. A closed cycle apparatus as claimed in claim 1, wherein the means for cooling and padding the dyed textile or plastic material comprises:

an exterior housing constructed so that the dyed textile or plastic material traverses therethrough;
a plurality of rollers disposed within said housing for conveying the material therethrough;
an air inlet conduit and an air exhaust conduit fluidly connected to said housing;
a first air pump means fluidly connected to said air inlet conduit and a second air pump means fluidly connected to said air exhaust conduit;
a plurality of air plenums fluidly engaging said first air pump means and positioned within said housing and substantially adjacent the dyed textile or plastic material traversing said housing;
a plurality of air jet means fluidly engaging said plurality of air plenums and directed towards the material passing thereby;
a condenser means fluidly engaging said second air pump means for condensing residual high boiling organic liquid vapors to liquid form;
means for recycling the high boiling organic liquid from said condenser to said dyeing apparatus; and
means for withdrawing residual dye collected at said cooling and padding means and recirculating same to said dyeing apparatus.

9. A closed cycle apparatus as claimed in claim 8, wherein said plurality of air jet means comprises a plurality of tubes.

10. A closed cycle apparatus as claimed in claim 9, wherein said first and second air pump means comprise air blowers.

11. A closed cycle apparatus as claimed in claim 10, including a first air lock positioned at the entrance of the dyed textile or plastic material to said exterior housing and substantially between said dye apparatus and said means for cooling and padding and a second air lock positioned at the exit of the dyed textile or plastic material from said exterior housing and substantially between said means for cooling and padding and said means for washing so as to minimize the amount of oxygen allowed into said means for cooling and padding.

12. A closed cycle apparatus as claimed in claim 11, including a switch means for actuating said means for withdrawing residual dye when the level thereof reaches a predetermined depth within said exterior housing.

13. A closed cycle apparatus as claimed in claim 12, wherein the means for withdrawing used dye from said exterior housing and recirculating same to said dye apparatus comprises:

a filter means fluidly connected to said housing;
a first fluid pump fluidly engaging said filter means so as to withdraw residual dye when actuated by said switch means;
a used dye storage means;
a make-up dye storage means;
a first conduit means fluidly connected at a first point to said first fluid pump, at a second point to said used dye storage means, and at a third point to said make-up dye storage means;
a control means fluidly connected to said first conduit for controlling whether the used dye is pumped to said used dye storage means or said make-up dye storage means;

a distillation apparatus with associated pump means for separating the high boiling organic liquid from dyestuff contained therein;

a second conduit means fluidly connected at one end to said used dye storage means and at the other end to said distillation apparatus for transporting the used dye to said distillation apparatus;

a high boiling organic liquid storage means;

a fresh dyestuff storage means;

a third conduit means fluidly connected at one end to said distillation apparatus and at the other end to said high boiling organic liquid storage means for transporting the distilled high boiling organic liquid to said high boiling organic liquid storage means thereby leaving only concentrated dyestuff in said distillation apparatus;

a second fluid pump and a third fluid pump fluidly connected to said dyestuff storage means and said high boiling organic liquid storage means, respectively;

a homogenizer fluidly connected to said second and third fluid pumps for blending the high boiling organic liquid and the fresh dyestuff into a dye;

a fourth conduit means fluidly connected at one end to said homogenizer and at the other to said dye storage means for transporting the dye to said dye storage means prior to its utilization in said dyeing apparatus; and means for transporting dye from said dye storage means to said dyeing apparatus.

14. A closed cycle apparatus as claimed in claim 13, wherein the means for recycling of the high boiling organic liquid from said condenser to said dyeing apparatus includes a fifth conduit means connected at one end to said condenser and at the other end to said high boiling organic liquid storage means.

15. A closed cycle apparatus as claimed in claim 1, wherein the means for washing the dyed textile or plastic material comprises:

an exterior housing constructed so that the material traverses therethrough and the environment therein is maintained substantially vapor-tight and oxygen-free;

a plurality of rollers positioned within said housing for conveying the material through said means for washing;

a plurality of spray means positioned within said housing and substantially adjacent the material and at least a portion of said plurality of rollers for spraying wash liquor thereon;

a plurality of wash tanks positioned within said housing substantially at the bottom thereof for collecting residual wash liquor not absorbed by the material;

a first fluid pump;

a first conduit means fluidly connected at one end to said wash tanks and at the other end to said first fluid pump for recycling the residual wash liquor and residual high boiling organic liquid and residual dyestuff contained therein;

a first filter means fluidly connected to said first conduit means between said wash tanks and said first fluid pump;

a storage means for mixed residual wash liquor and residual high boiling organic liquid and residual dyestuff contained therein;

a second conduit means fluidly connected at one end to said first pump and at the other end to said storage means; and a separatory means fluidly connected to said storage means for separating the residual low boiling organic wash liquid from the residual high boiling organic liquid and residual dyestuff and means for returning the wash liquor to said means for washing and the residual high boiling organic liquid and residual dyestuff to said dyeing apparatus.

16. A closed cycle apparatus as claimd in claim 15, wherein said plurality of wash tanks are disposed in a series beginning substantially adjacent the wall of said housing most remote from said dyeing apparatus.

17. A closed cycle apparatus as claimed in claim 16, including a switch means for actuating said first fluid pump when the level of residual wash liquor reaches a predetermined level within said wash tanks.

18. A closed cycle apparatus as claimed in claim 17, wherein said separatory means comprises:

a first distillation apparatus with associated pump means for separating the residual low boiling organic wash liquid from the residual high boiling organic liquid and residual dyestuff;

a condenser means fluidly connected to said first distillation apparatus for condensing the low boiling organic wash liquid vapors to liquid form;

a wash solvent storage means fluidly connected to said condenser means for collecting the low boiling organic wash liquid;

a third conduit means connected at one end to said wash solvent storage means and at the other end to said plurality of spray means within said means for washing;

a second fluid pump fluidly connected to said third conduit means for pumping the low boiling organic wash liquid from said wash solvent storage to said plurality of spray means;

a second filter means fluidly connected to said third conduit means between said wash solvent storage means and said second fluid pump;

a dye solvent storage means fluidly connected to said first distillation apparatus;

a used dye storage means;

a fourth conduit means fluidly connected at one end to said first distillation apparatus and at the other end to said used dye storage means;

a third fluid pump fluidly connected to said fourth conduit means for pumping high boiling organic liquid and residual dyestuff contained therein to said used dye storage means;

control means for controlling whether the high boiling organic liquid and residual dyestuff remaining after the wash liquor is distilled off is sent to said dye solvent storage means or said used dye storage means;

a second distillation apparatus with associated pump means for separating the high boiling organic liquid from the residual dyestuff contained therein;

a fifth conduit means fluidly connected at one end to said used dyed storage means and at the other end to said second distillation apparatus;

a sixth conduit means fluidly connected at one end to said second distillation apparatus and at the other end to said dye solvent storage means for transporting the distilled high boiling organic liquid to said dye solvent storage means thereby leaving only concentrated dyestuff in said second distillation apparatus;

a fresh dyestuff storage means;

a make-up dye storage means;

a fourth fluid pump and fifth fluid pump fluidly connected to said fresh dyestuff storage means and said dye solvent storage means, respectively;

a homogenizer fluidly connected to said fourth and fifth fluid pumps for blending the high boiling organic liquid and the dyestuff into a dye;

a seventh conduit means fluidly connected at one end to said homogenizer and at the other end to said dye storage means for transporting the dye to said dye storage means prior to its utilization in said dyeing apparatus; and means for transporting dye from said dye storage means to said dyeing apparatus.

19. A closed cycle apparatus as claimed in claim 18, including a first air lock positioned at the entrance of the textile or plastic material to said housing and substantially between said means for cooling and padding and said means for washing, and a second air lock positioned at the exit of the textile and plastic material from said housing.

20. A closed cycle apparatus as claimed in claim 19, including an inert gas purge to the atmosphere fluidly engaging said exterior housing.

21. A closed cycle apparatus as claimed in claim 20, including an air purge vent to the atmosphere fluidly engaging said exterior housing.

22. A closed cycle apparatus as claimed in claim 18, wherein said plurality of wash tanks comprises:

three tanks arranged in a series with the first tank disposed substantially adjacent the wall of said housing most remote from said dyeing apparatus;

three sets of spray means each disposed above one of said tanks with the first of the sets disposed above the first tank and fluidly connected to said third conduit, fluidly connected to said wash solvent storage means;

a sixth fluid pump fluidly connected to both the second and third of said wash tanks;

a third filter means fluidly connected between the third of said wash tanks and said sixth fluid pump;

an eighth conduit means connected at one end to said sixth fluid pump and at the other end to the set of spray means disposed above the third of said wash tanks so as to recycle residual wash liquor from the second and third of said wash tanks to the third thereof;

a seventh fluid pump fluidly connected to the first and second tank of said wash tanks;

a fourth filter means fluidly connected between the second tank of said wash tanks and said seventh fluid pump; and a ninth conduit means fluidly connected at one end to said seventh fluid pump and at the other end to the set of spray means disposed above said second wash tank so as to recycle wash liquor from the first and second wash tank back to the second wash tank.

23. A closed cycle apparatus as claimed in claim 22, including a tenth conduit means fluidly connected at one end to said ninth conduit means with a fluid valve positioned therebetween and at the other end to the spray means positioned adjacent said plurality of rollers for flushing said means for washing when clean wash liquor is pumped therethrough.

24. A closed cycle apparatus as claimed in claim 23, wherein said plurality of spray means comprises a plurality of spray heads with an associated plurality of spray jets positioned transversely across and above each of said wash tanks so that the textile or plastic material is conveyed adjacently thereto and a plurality of spray heads with an associated plurality of spray jets dispersed transversely across and above said plurality of rollers positioned at the top of said housing.

25. A closed cycle apparatus as claimed in claim 24, including a flushing means for said dyeing apparatus and said means for cooling and padding comprising additionally:

spray means disposed within said dyeing apparatus and said cooling and padding apparatus in such a manner as to be capable of flushing same;

an eleventh conduit means fluidly connected at one end to said wash solvent storage means and at the other end to said spray means; and an eighth fluid pump fluidly engaging said eleventh conduit means for pumping wash liquor to said spray means and thereby flushing said dyeing apparatus and said means for cooling and padding.

26. A closed cycle apparatus as claimed in claim 25, including a first air lock positioned at the entrance of the dye textile or plastic material to said housing and substantially between said means for cooling and padding and said means for washing and a second air lock positioned at the exit of the dyed textile or plastic material from said housing and substantially between said means for washing and said means for drying so as to minimize the amount of oxygen allowed into means for washing.

27. A closed cycle apparatus as claimed in claim 1, wherein downstream of and next adjacent to said means for washing additional equipment is provided for performing finishing operations on the washed dyed textile or plastic material.

28. A closed cycle apparatus as claimed in claim 1, wherein the means for drying the dyed textile or plastic material with warm air comprises:

an exterior housing constructed so that the material traverses therethrough;

a plurality of rollers to convey the material through said housing;

an air inlet conduit fluidly connected to said housing for allowing air to enter therein;

a heating means fluidly connected to said air inlet conduit so as to heat the entering air;

a first air pump means fluidly connected to said air inlet conduit so as to pull air over said heating means and convey the air through said air inlet conduit toward said exterior housing;

a plurality of air plenums with a plurality of holes therein with at least one surface thereof fluidly engaging said first air pump means and positioned within said housing so as to be positioned substantially adjacent the material traversing therethrough;

an exhaust conduit positioned within said housing and extending therethrough;

a second air pump means fluidly engaging said exhaust conduit so as to pull exhausted air containing wash liquor vapors from said housing;

a condenser means fluidly connected at one end to said second air pump means and at the other end to said air inlet conduit for condensing the residual wash vapors and for allowing the processed air to be recirculated to said air plenums;

a wash solvent storage means;

a first conduit means connected at one end to said condenser and at the other end to said wash solvent storage means so as to transport the condensed wash liquor vapors thereto;

a filter means fluidly engaging said wash solvent storage means;

a fluid pump means fluidly engaging said filter means; and a second conduit means connected at one end to said pump means and at the other end to said means for washing.

29. A closed cycle apparatus as claimed in claim 28, including one or more vent or damper means rotatably disposed within said air inlet conduit for controlling the flow of air into said housing.

30. A closed cycle apparatus as claimed in claim 29, including one or more vent or damper means rotatably disposed within said air exhaust conduit for controlling the flow of air to said second air blower.

31. A closed cycle apparatus as claimed in claim 30, including an air purge vent to the atmosphere fluidly engaging said exterior housing.

32. A closed cycle apparatus as claimed in claim 31, including an inert gas purge vent to the atmosphere fluidly engaging said exterior housing.

33. A closed cycle apparatus as claimed in claim 32, including a first air lock positioned at the entrance of the plastic or textile material to said housing and substantially between said means for washing and said means for drying and a second air lock positioned at the exit of the material from said housing.

34. A closed cycle apparatus as claimed in claim 33, wherein said heating means comprises one or more steam pipes disposed within said air inlet conduit upstream of said first air pump means and substantially adjacent said exterior housing.

35. A closed cycle apparatus as claimed in claim 34, wherein the high boiling organic liquid comprises a glycol or glycol ether and the low boiling organic wash liquid comprises methanol or ethanol.

36. A closed cycle apparatus as claimed in claim 33, wherein said second air lock is a terminal air lock comprising:

a third conduit means extending therefrom the exit point of the textile or plastic material from said means for drying and substantially enclosing the textile or plastic material passing therethrough;

a fourth conduit means fluidly engaging said third conduit means at a point substantially in the middle thereof; and a third air pump means vented to the atmosphere fluidly engaging said fourth conduit means so as to pull atmospheric air into said third conduit means through the open end thereof and deodorize the textile or plastic material passing therethrough to said means for taking-up the dried and finished textile or plastic material.

37. A closed cycle apparatus as claimed in claim 36, including a condenser fluidly connected to said third air pump means at one end thereof and to said wash solvent storage means at the other end thereof for collecting and condensing wash liquor vapors.

38. A closed cycle apparatus as claimed in claim 37, wherein said air pump means comprise air blowers.

* * * * *